US005158386A

United States Patent [19]

Mann, Jr.

[11] Patent Number: 5,158,386

[45] Date of Patent: Oct. 27, 1992

[54] RING BINDER SEPARATOR

[76] Inventor: John C. Mann, Jr., 29 Tuthill Point Rd., East Moriches, N.Y. 11940

[21] Appl. No.: 727,129

[22] Filed: Jul. 9, 1991

[51] Int. Cl.[5] ..... B42F 3/04; B42F 13/22

[52] U.S. Cl. ..... 402/41; 402/34; 402/36; 402/76

[58] Field of Search ..... 402/34, 36, 41, 76

[56] References Cited

U.S. PATENT DOCUMENTS

| | | | |
|---|---|---|---|
| 504,317 | 9/1893 | Assmann . | |
| 788,023 | 4/1904 | Couch et al. . | |
| 842.851 | 2/1907 | Boden | 402/41 |
| 854,074 | 5/1907 | Bryant . | |
| 1,550,050 | 8/1925 | Schade . | |
| 1,556,721 | 10/1925 | Schade | 402/75 |
| 1,620,105 | 3/1927 | Jennings, Jr. | 402/46 |
| 1,742,827 | 1/1930 | Schade . | |
| 1,769,120 | 7/1930 | Dawson . | |
| 1,795,374 | 3/1931 | Martin . | |
| 1,995,735 | 3/1935 | Dawson et al. . | |
| 2,104,046 | 1/1938 | Krag . | |
| 2,142,786 | 1/1939 | Haskin . | |
| 2,212,380 | 8/1940 | Steele . | |
| 2,246,763 | 6/1941 | Schlosser . | |
| 2,251,614 | 8/1941 | Martin . | |
| 2,311,090 | 2/1943 | Schade . | |
| 2,322,596 | 6/1943 | Schade | 402/76 X |
| 2,377,179 | 5/1945 | Pitt . | |
| 2,381,040 | 8/1945 | Dawson et al. . | |
| 2,572,305 | 10/1951 | Bloore . | |
| 2,875,767 | 3/1959 | Cougoul . | |
| 2,928,398 | 3/1960 | Rankin . | |
| 2,947,309 | 8/1960 | Bennett . | |
| 3,074,744 | 1/1963 | Pucci et al. | 281/37 |
| 3,105,494 | 10/1963 | Duncan et al. . | |
| 3,111,949 | 11/1963 | Duncan et al. . | |
| 3,255,759 | 6/1966 | Dennis | 402/30 |
| 3,734,634 | 5/1973 | Fenston | 402/56 |
| 3,827,111 | 8/1974 | O'Connell | 402/20 X |
| 3,833,308 | 9/1974 | Seaborn | 402/56 |
| 3,944,374 | 3/1976 | Young et al. | 402/33 |
| 3,954,343 | 5/1976 | Thomsen | 402/41 |
| 3,995,961 | 12/1976 | Dorfman et al. | 402/38 |
| 4,130,368 | 12/1978 | Jacoby et al. | 402/41 |
| 4,281,940 | 8/1981 | Rhee | 402/38 |
| 4,815,882 | 3/1989 | Ohminato | 402/30 X |
| 4,904,103 | 2/1990 | Im | 402/41 X |
| 4,948,286 | 8/1990 | Hofmann | 402/34 |

FOREIGN PATENT DOCUMENTS

| | | | |
|---|---|---|---|
| 630676 | 6/1936 | Fed. Rep. of Germany . | |
| 1400984 | 4/1965 | France | 402/41 |

*Primary Examiner*—Paul A. Bell

*Attorney, Agent, or Firm*—McAulay Fisher Nissen Goldberg & Kiel

[57] ABSTRACT

A ring separator has a pair of members disposed in a facing relationship, the members pivotable about a common axis. Each member has an arcuate channel with the channels aligned in a facing relationship to form a bearing passage. A bearing element is placed within the passage and is movable in an axial direction. Each channel has one or more directing grooves, which receive one or more projections mounted on the bearing. As the bearing element moves axially, the projections direct the members along an arcuate path to open and close the rings mounted thereon. Such a ring separator mechanism has few parts and is easily produced by extrusion or injection molding, thus, providing a ring separator of reduce cost and simple construction.

11 Claims, 8 Drawing Sheets

RING BINDER SEPARATOR

CROSS REFERENCE TO RELATED APPLICATION

This application is related to the applicant's copending application titled "Ring Binder Adaptor For Removable Covers", attorney docket no. GK-MDT-368K, filed on even date herewith.

TECHNICAL FIELD

This invention relates to ring binders and more particularly to multi-ring binders having a longitudinally displaceable ring separator and means for attaching separable covers thereto.

BACKGROUND

There are various types of ring binders available with the most common employing three separable ring assemblies spaced at fixed locations on a metal backing member. Front and rear covers extend from a backing strip which is typically riveted to th backing member. The ring assemblies usually have complementary arcuate ring halves, having fixed ends anchored to the backing member. Typically, a spring assembly is included for biasing the opposing ring halves into engagement. The ring halves are separable into an open locked position when sheets are added to or removed from the binder. In some binders, the rings may be separated by pulling on the opposite ring halves while in others a pressure element, acting through the backing member and having handles disposed at one or both ends of the backing member may be provided to effect release.

In U.S. Pat. No. 3,833,308, a binder fixture is disclosed using a stationary base plate with T-shaped rails extending across an upper surface thereof, a channel formed in a lower surface thereof, and a pair of slots extending through the base plate of the channel. A longitudinally extending cam bar slides within the channel and has pins projecting through the slots in the bas plate. A slide plate is provided having T-shaped slots complementary to and in engagement with the T-shaped rails to permit a sliding movement of the slide plate on the base plate. Sliding the cam bar causes the ring halves on the base plate to separate.

Such ring separators require multipart construction and assembly, at increased cost and complexity. While such ring separators have been used, the search continues for improved separator mechanisms of simple construction which may be produced at lower cost yet which can function with fewer constraints.

SUMMARY OF INVENTION

It is an object of the present invention to provide a ring binder separator which is of simple, low cost construction.

It is a further object to provide a ring binder separator which avoids the use of springs but which is easily fixed in an open position.

It is a further object to provide a ring binder separator which requires a minimum amount of force for operation but which assures positive engagement to prevent inadvertent opening.

It is still a further object to provide a ring binder separator comprised of plastic elements which are capable of being manufactured by low cost extrusion or injection molding techniques.

It is yet another object to provide a ring binder separator mechanism which is adaptable for use with separable covers to improve storability.

These and other objects of the present invention are achieved by a ring binder separator comprising a first member, and, a second member disposed in a facing relationship to the first member, the members having ring means mounted thereon, each member having an arcuate channel, the channels located adjacent to each other and having at least one directing groove therein. The channels are configured on an arc of a circle, the center of which is coincident with a hinge line of the binder. A semi-cylindrical bearing element is slidably located within the channels, the bearing element having engaging means such as a pair of projections disposable within the channel grooves. Each member may optionally include means for attaching removable covers thereto.

By pulling on the bearing element, the projections, riding in the directing grooves, cause the members to separate along a common longitudinal axis, opening the ring means mounted on the members. Utilizing such a system minimizes part complexity and cost, yet assures positive opening and closure of the ring binder. The removable covers allow the empty binder to be disassembled and stored with a minimum of space, and also allows changing covers to correspond to binder content, or to change the binder's appearance.

FIG. *7a* is a view of the ring binder separator having a slot for lower attachment;

FIG. *7b* shows a track for cover attachment;

FIG. *7c* shows the embodiment of the FIG. *7b* in a side view;

FIGS. *7d* and *7e* show a notched edge cover attachment system.

Figures 8, 9:
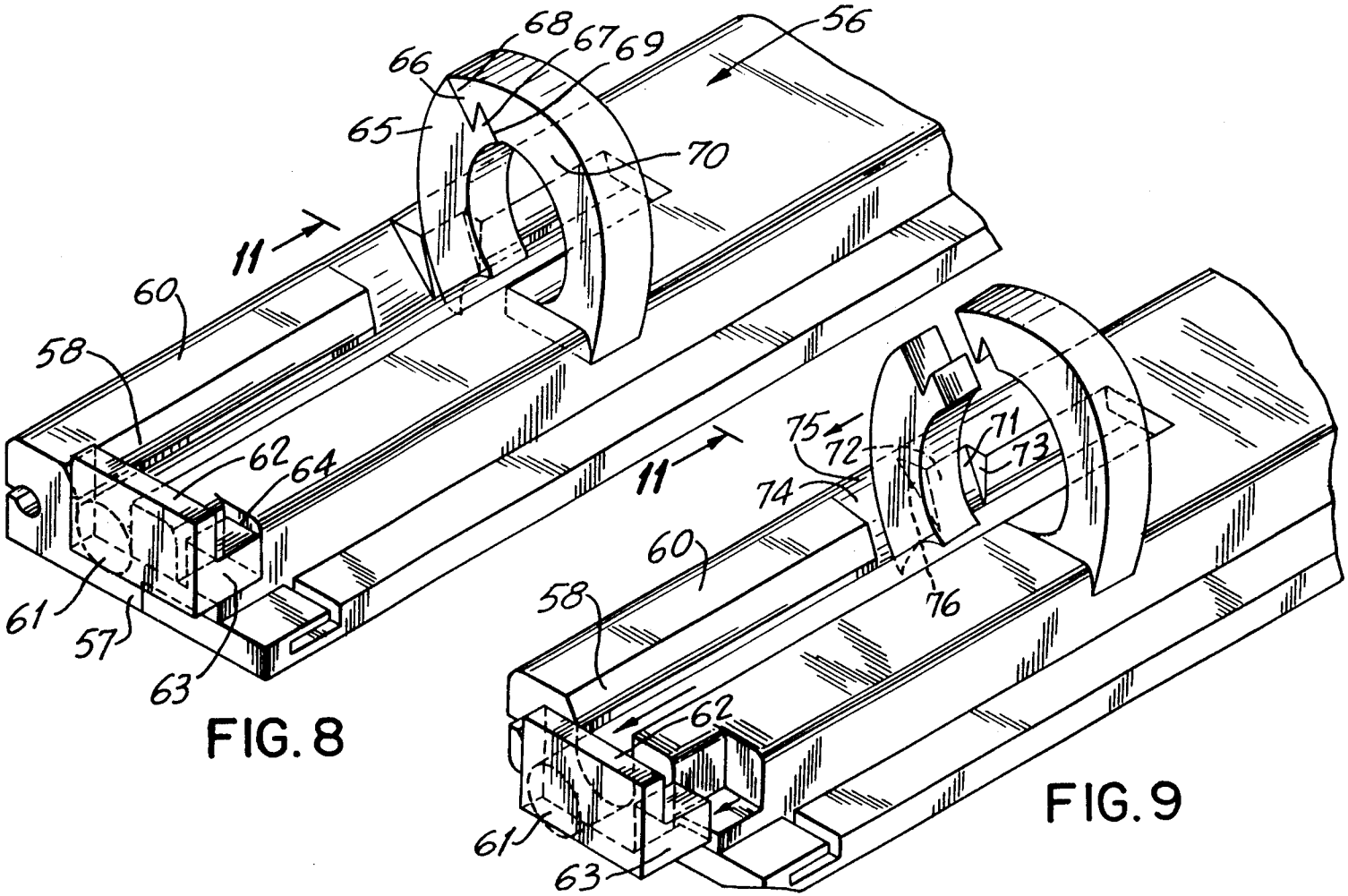

FIG. 8 is a perspective view of another embodiment of the ring binder separator of the present invention.

FIG. 9 is a perspective view of the ring binder separator of FIG. 8 shown in the partially open condition.

Figure 10:
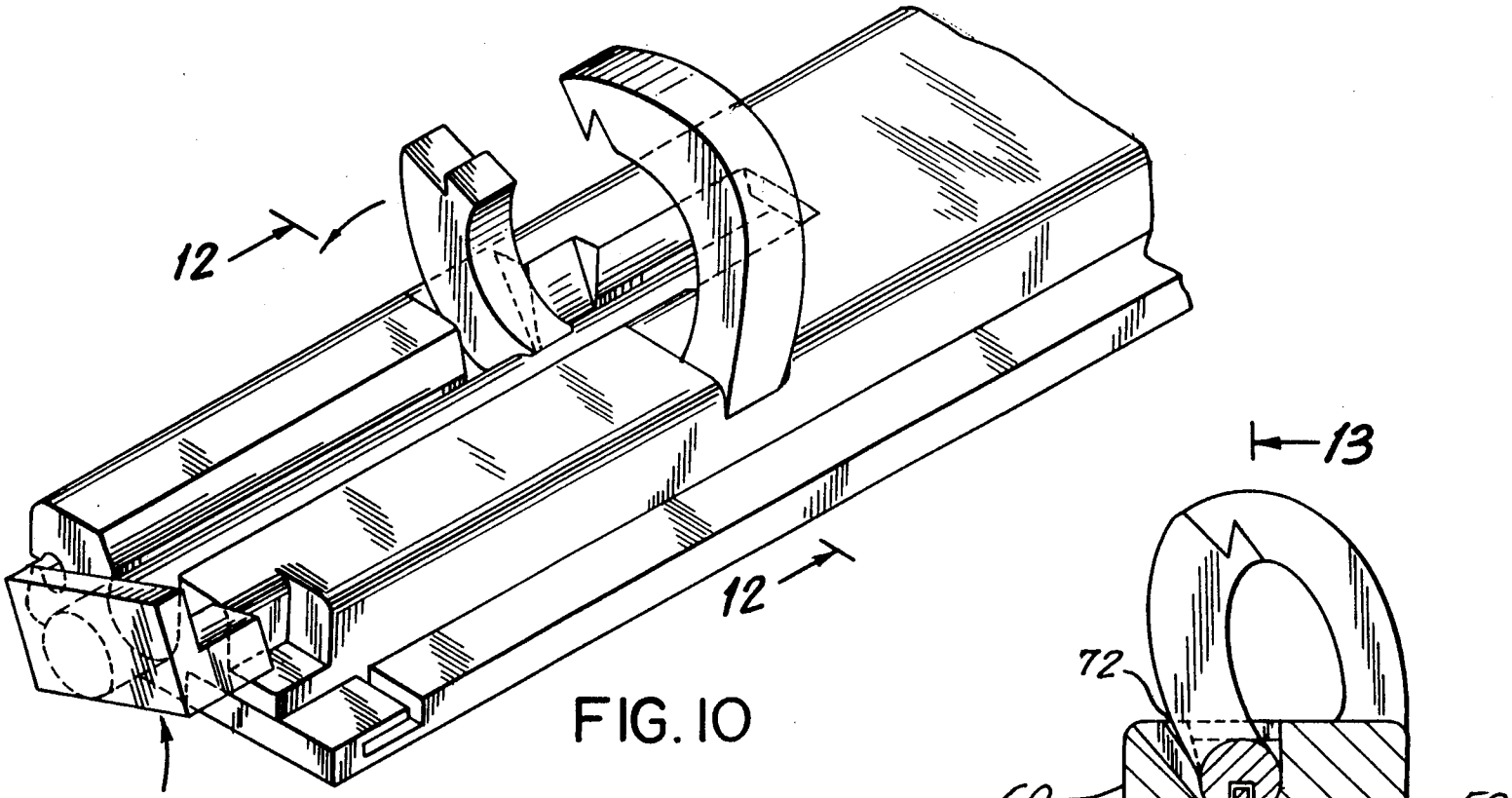

FIG. 10 is a perspective view of the ring binder separator of FIG. 8 shown in the full open condition.

Figure 11:
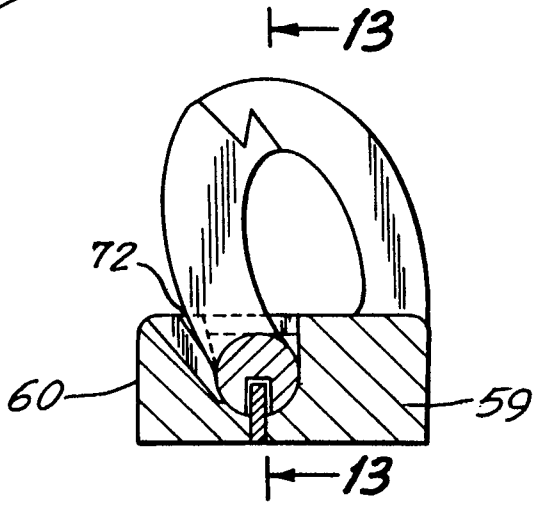

FIG. 11 is a cross sectional view of the ring binder separator of FIG. 8, taken along line 1—1.

Figure 12:
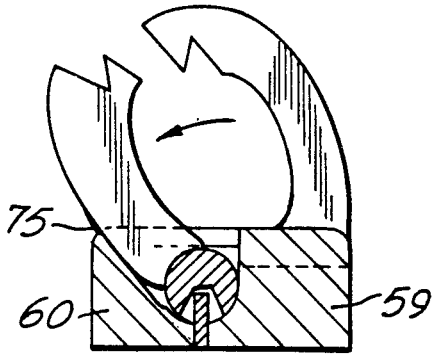

FIG. 12 is a cross sectional view of the ring binder separator of FIG. 10, taken along line 12—12.

Figure 13:
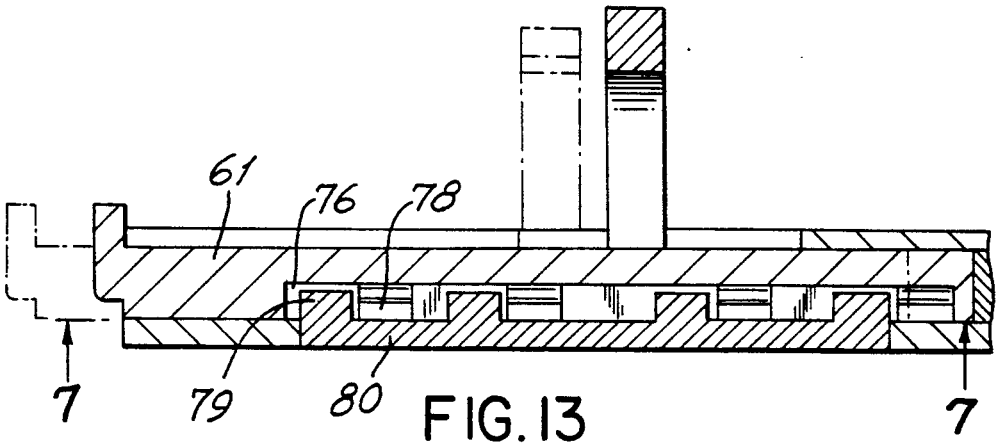

FIG. 13 is a cross sectional view of the ring binder separator of FIG. 11, taken along line 13—13.

Figure 14:
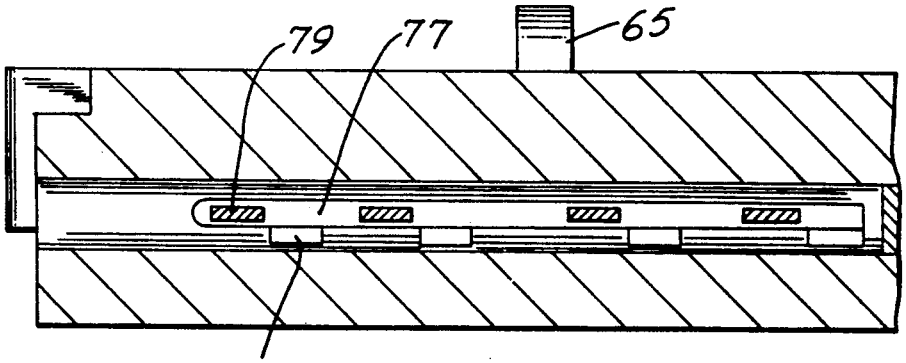

FIG. 14 is a cross sectional view of the ring binder separator of FIG. 13, taken alone line 14—14.

DETAILED DESCRIPTION OF THE INVENTION

Figures 1, 2:
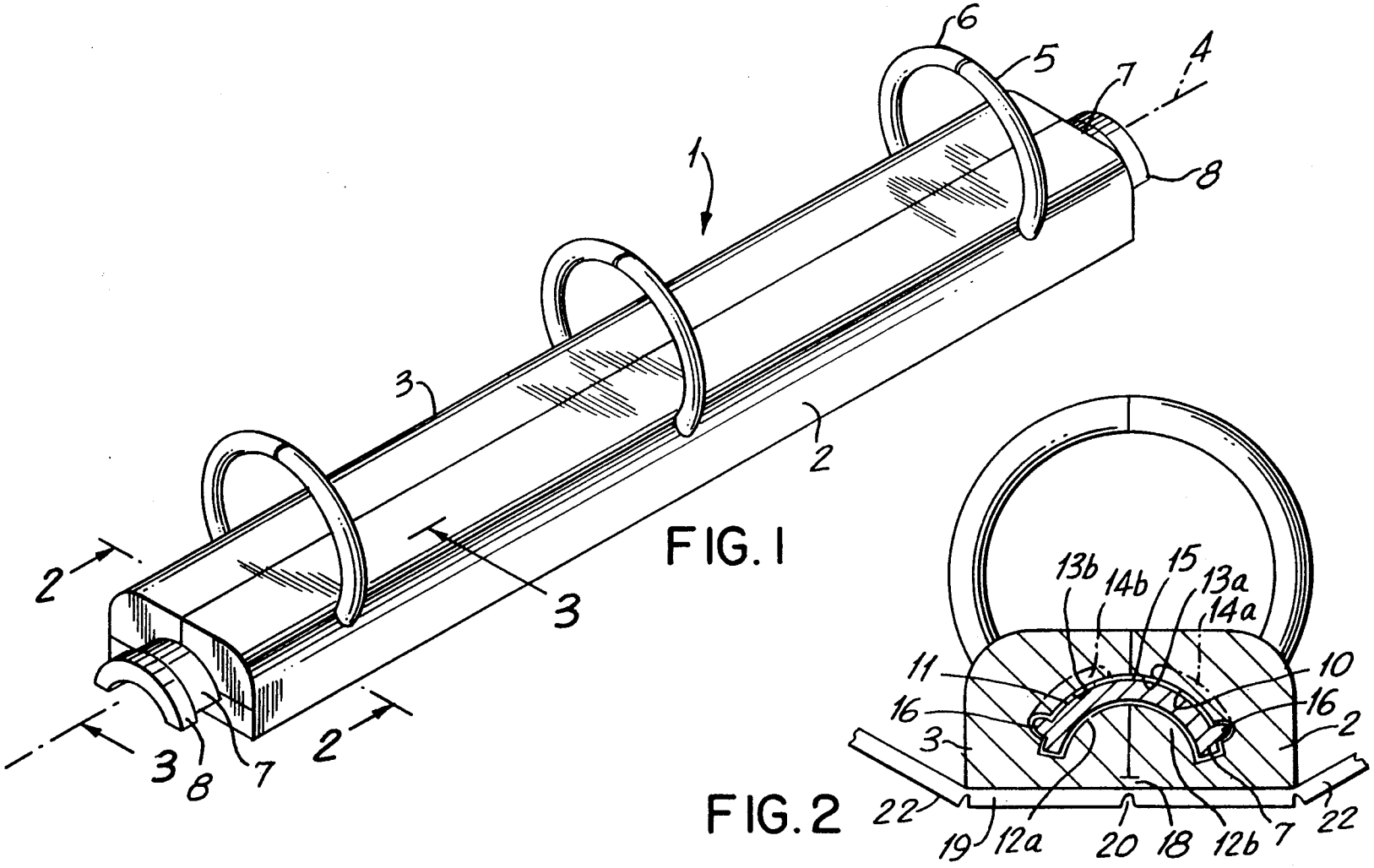
FIG. 1 is a perspective view of one embodiment of a ring binder separator of the present invention.
FIG. 2 is a cross-sectional view of the ring binder separator of FIG. 1, taken along line 2—2.

Referring to FIG. 1, a ring binder separator 1 has a first member 2 and a second member 3. The first and second members are complementary mirror images of each other. Both members pivot about a common longitudinal axis 4 which forms a hinge line. Each member has three ring halves, 5 and 6, respectively, fixedly attached and disposed in a facing relationship The rings are spaced apart and of sufficient diameter to retain a selected number of pages between the rings when engaged. Of course, one or more rings may be used with the present invention, and three rings are shown for illustrative purposes only. A pair of bearings elements 7 with handles 8 extend from opposite ends of the members 2 and 3. Of course, one long bearing would also work as well.

Referring to FIG. 2, the members 2 and 3 have adjacent bearing channels 10 and 11, respectively with the channels disposed in an opposing relationship. The channels align to form an arcuate bearing passage. The bearing element 7 rests on the facing channel lower surfaces 12*a* and 12*b* which act as a support. Each channel upper surface, 13*a* and 13*b*, has at least one directing groove 14*a* and 14*b* inscribed in a inward and downward direction.

The arcuate bearing element 7 has a top surface 15 which has a curvature to match the curvature of the channel upper and lower surfaces. This curvature is chosen to have a radius origin point which coincides with the hinge line of the ring separator, to allow smooth operation without binding. Thus, the bearing element slides within the arcuate bearing passage, maintaining its longitudinal orientation and only traversing in an axial direction.

The bearing element has four projections 16, located within the directing grooves 14 in the channel surfaces. The projections are positioned on the bearing element such that when the bearing element is in its innermost position, within the channels, the members and their associated rings are closed. As the bearing element is drawn axially out of the channels, the projections riding in the grooves direct the members to translate about the axis 4, separating and opening the rings. It will be seen that the projections extend in alignment with the hinge-to-bearing arc radius. Other embodiments may have the projections facing in toward the hinge and it is also contemplated that the projections be an integral part of members 2 and 3, sliding in directing grooves situated in the bearing elements as this 7 would be equally as effective as the discussed embodiment.

Figures 3, 4:
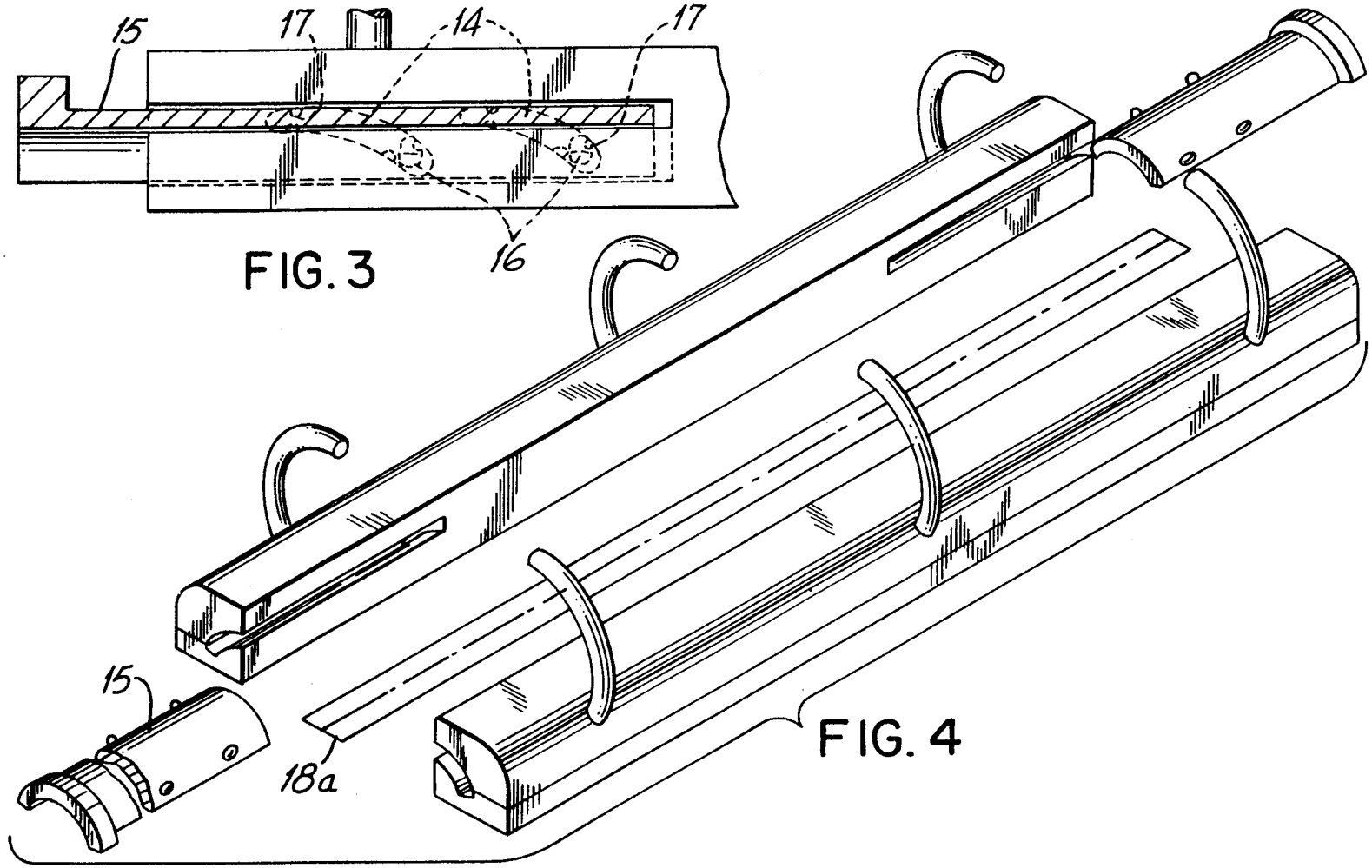
FIG. 3 is a cross-sectional view of the ring binder separator of FIG. 1, taken along line 3—3.
FIG. 4 is an exploded view of another embodiment of the ring binder separator of the present invention.

FIG. 3 shows the projection within the directing grooves, which may optionally include inwardly projecting ridges 17 at the ends thereof. These ridges resist travel of the projections in the grooves in a degree sufficient to cause positive engagement when the projections are forced past them, i.e. when the binder is in the full open or full closed position. Thus the binder provides a snap lock feel to the operator.

The members 2 and 3 are attached by a hinge which may either be integrally molded with the members or an added structure. For example, if the members are formed of plastic, a "living" hinge 18 may suffice, as shown in FIG. 2. Such a hinge typically comprises a seam or joining portion of minimum thickness which allows the members to flex about the seam. Referring to FIG. 4, a separate hinge 18*a*, which may be attached by rivets, adhesive or other means, is used.

Referring again to FIG. 2, the members 2 and 3 are mounted on a strip 19 which forms the backing of the binder. The backing strip 19 is somewhat rigid but has a crease 20 parallel to the hinge 18 to allow the members to separate if desired, the backing strip crease should act alone as the separate hinge 18*a*. The backing strip is attached to the members 2 and 3 by using rivets, adhesives, etc. A pair of covers 21 and 22 extend from the backing strip to complete the ring binder.

The ring binder separator components may be composed of metal or plastic such as polyvinyl chloride (PVC), ABS resins, nylon and combinations thereof or fiberglass or other filed plastics or another composite material. However, a plastic resin such as ABS is preferred as it is an economic material, having sufficient strength and flexibility for long term use. The components made of such a material are also easily mass produced by low cost extrusion or injection molding processes. The backing members and covers may be composed of cardboard, semi-rigid plastic or another conventional material typically used to produce such structures.

Figures 5, 6:
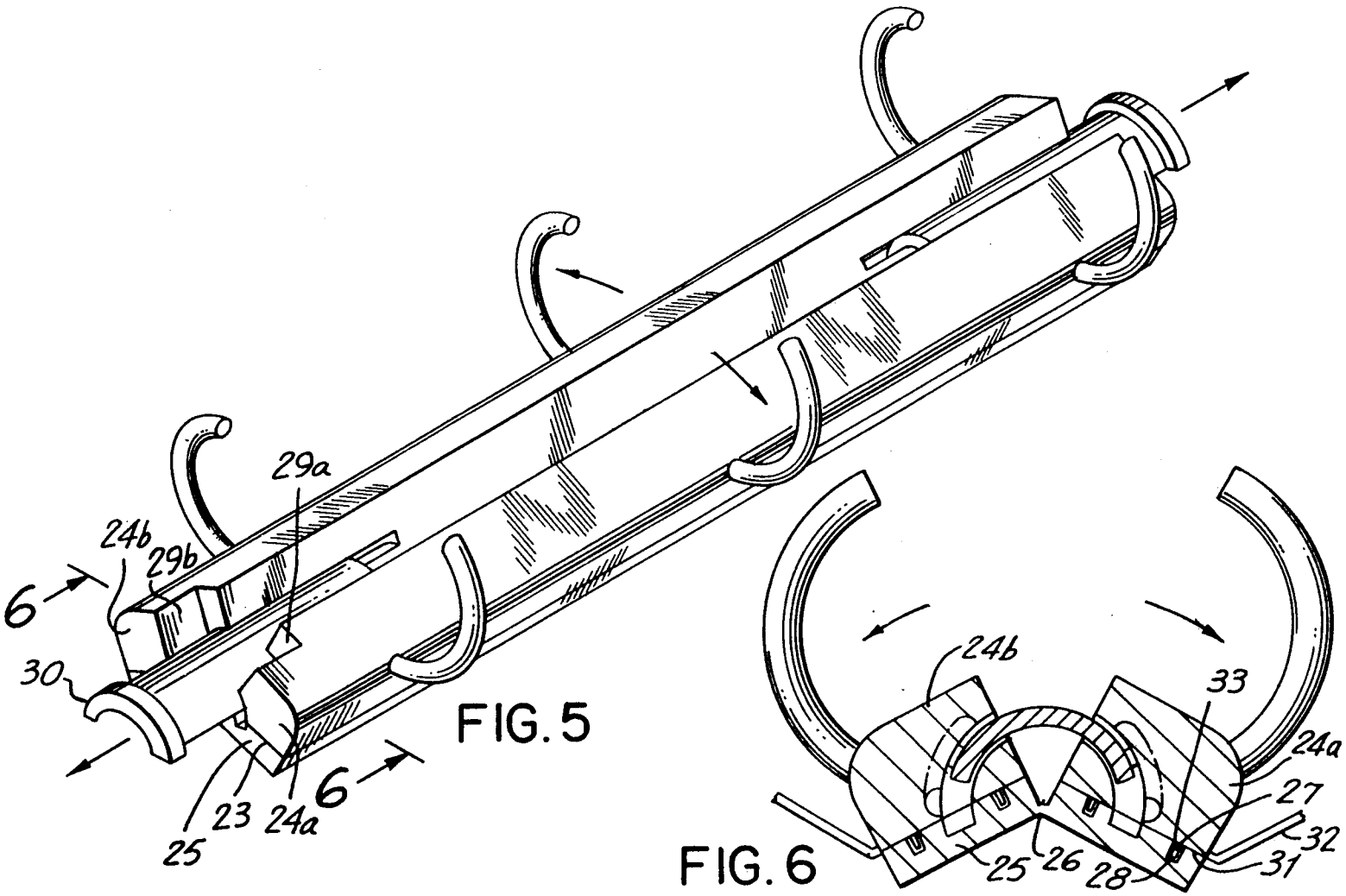
FIG. 5 is a perspective view of another embodiment of the ring binder separator shown in the open position.
FIG. 6 is a cross-sectional view of the ring binder separator of FIG. 5, taken along line 6—6.

In another embodiment, the members are produced in upper and lower portions to facilitate incorporation of the bearing element in the ring binder separator assembly. Referring to FIG. 5, a parting line 23 divides the separator into two upper member portions 24*a* and 24*b* and a lower member portion 25 which has a living hinge 26. The upper and lower portions are attached by an adhesive, by using pins 27 and mating receptacles 28 as shown in FIG. 6 or using other attachment structures. The two upper portions also have recesses 29*a* and 29*b* which allow nesting of a handle 30 therein. This gives the mechanism a stream lined appearance and may help facilitate an additional locking mechanism for the bearing element for positive closing action. Even using this construction, the ring binder separator is assembled with a minimum number of parts which are easily fabricated at low cost.

The ring binder separator is preferably used with cover attachment means which allow separate back and front covers to be added thereto. This increases the storage density of empty binders and allows decorative or informative covers to be interchanged with the separator to correspond to the contents of the binder.

Referring to FIG. 6, a connector 31 which holds a cover 32 to the member 24*a*, has holes 33 which are engaged by the pins 27 which extend from the upper member portion 24*a* and pass through the holes into receptacles 28 in the lower member 25, attaching the covers to the member at the same time that the bearing is located in the members. Thus, the binder is assembled in one easy step. To remove the cover, the upper and lower portions are separated, the cover removed and a new cover inserted in alignment with the pins.

Figure 7A:
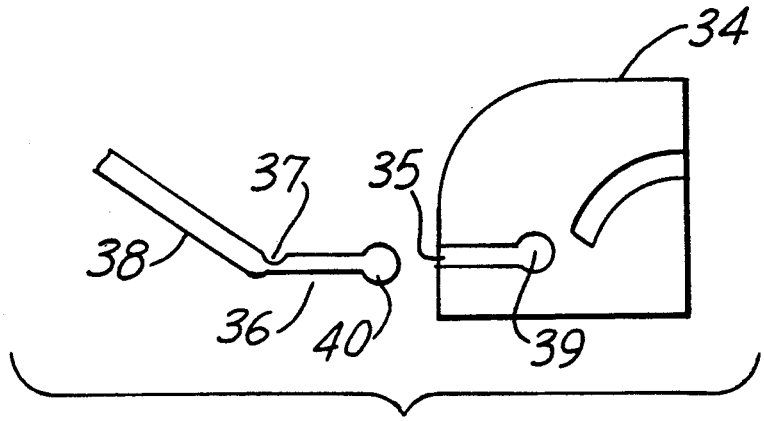

Referring to FIG. 7*a*, a member 34 has a continuous longitudinal slot 35 disposed in an outer wall thereof. The slots are of sufficient width to accept a cover hinge connector 36 therein. The connector should be sufficiently resilient to provide an interference fit in the slot and allow the cover to traverse about a hinge portion 37 of the connector. This could be provided by having a relatively thinner portion between the connector 36 and a cover 38. In this embodiment, the slot 35 additionally has an enlarged diameter opening 39 to accept a correspondingly enlarged connector portion 40 to provide positive engagement between the cover and the member. The cover is attached by sliding the connector 36 into the slot from an end of the member.

Figure 7B:
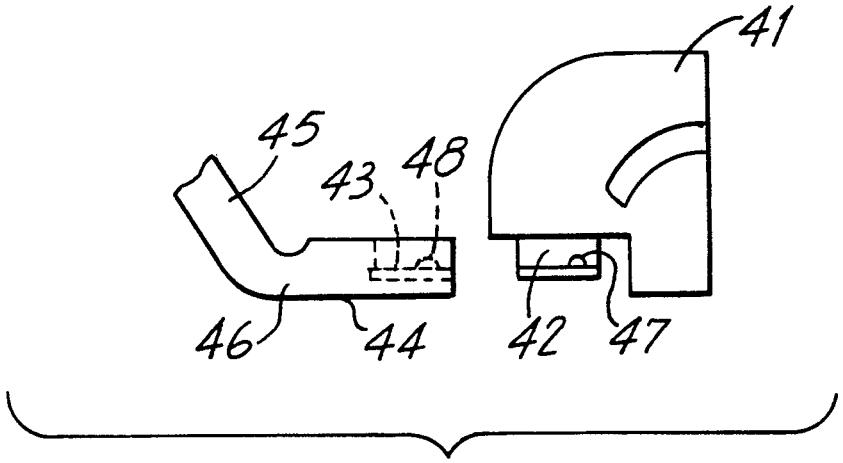
Figure 7C:
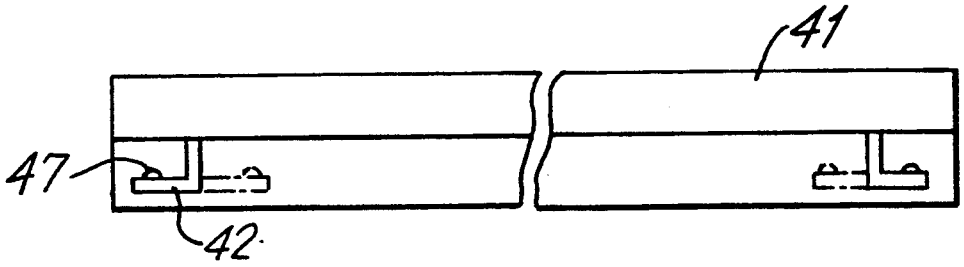
Figure 7D:
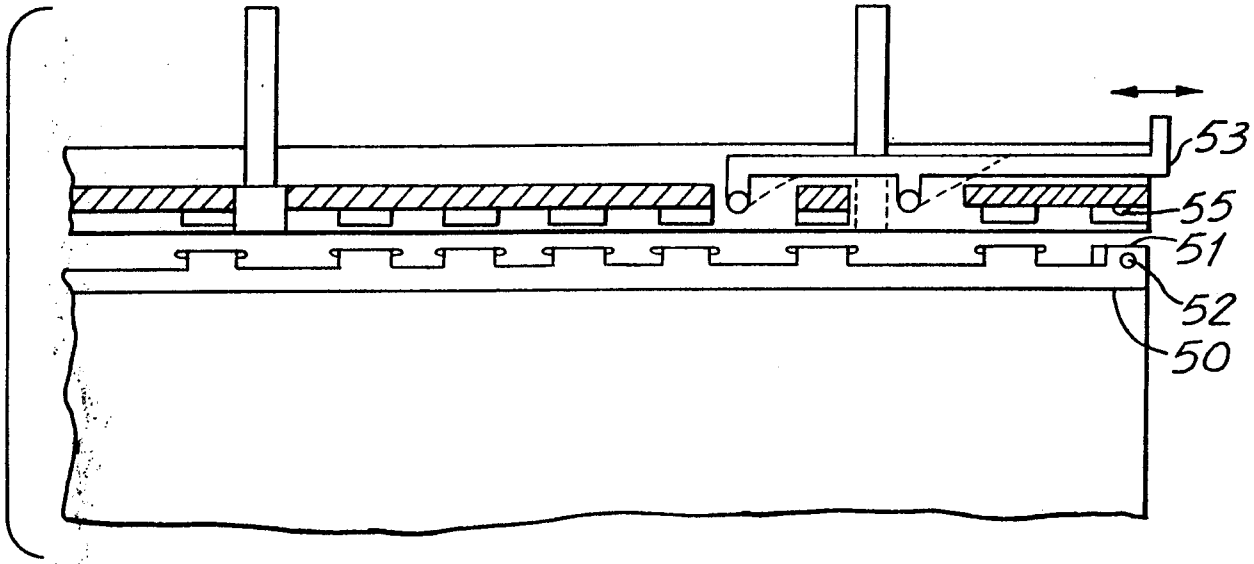
Figure 7E:
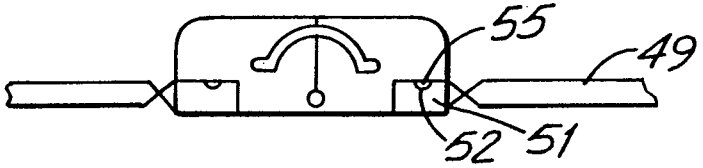

In another embodiment shown in FIG. 7*b*, a member 41 has L or T shaped tracks 42 which mate with channels 43 in a cover connector 44 to allow a cover 45 to be slid onto the tracks. The cover has an integral hinge 46 to allow the cover to open and close. Ridges 47, similar to the ones described in the directing grooves, are used in the tracks and mate with sockets 48 in the cover connector channels 43 to provide a snap fit when the cover is properly located. These structures are easily incorporated by molding. FIG. *7c* shows this embodiment in a side view, with the T-shaped tracks in phantom.

Referring to FIGS. *7d* and *7e*, a cover 49 has a hinge 50 and a notched edge portion 51. The portion 51 has a pair of locating holes 52. A member 53 has corresponding discontinuous slots 54 which align with the notches in the edge and has a pair of projections 55 which engage the locating holes 52 to snap the cover in position. By using a notched portion, there is no continuous channel through the member 53, allowing a high strength member to be produced yet be very thin as the solid portions are located adjacent the rings. The number of notches and insert areas vary, depending on the type of binder and strength requirement. This allows the members to be fairly thin for a slim, narrow profile, yet be usable with removable covers.

Another ring binder separator is shown in FIGS. 8-14. While designed primarily for use in large width binders which customarily utilize heavy duty or "D" shaped rings, this ring binder separator is adaptable for use in any size ring binder.

Referring to FIG. 8, a ring binder separator 56 has a base 57 with a longitudinal aperture 58 defined by a pair of side members 59 and 60. A shaft 6 is disposed within the aperture and is reciprocally movable therein. A handle 62 is attached to the shaft and has an extension 63 which nests within a recess 64 in the member 53.

A first ring portion 65 extends from the shaft 61 and has a sloped surface 66 which leads to an upward projection 67 with the surface and projection matable with a corresponding sloped surface 68 and a recessed 69 in a second ring portion 70 which extends from the member 59. The ring portion mounted on the shaft is movable axially in and out of alignment with the second ring portion which is fixed on the member 59.

Referring to FIG. 9, the shaft 61 is shown axially displaced within the aperture 58, such that the ring portions are out of alignment. The side member 60 has a first supporting channel 71 comprised of a shoulder 72 and a stop 73, with the channel accepting the first ring portion 65 and supporting it when th ring portions are engaged. The shoulder 72 also assures proper alignment of the ring portions during axial displacement into an out of engagement.

A second supporting channel 74 is provided in the member 60 and includes a shoulder 75 and a stop 76. As shown in FIGS. 11 and 12, the supporting channels accept and support the movable ring portion when fully engaged or fully disengaged from the static ring portion. The stop 75 prevents the ring portion 65 from being movable into contact with the static ring portion unless rotated into alignment with the sloped surface 68 and recess 69 of the static ring portion. The stop 75 is a wall of the first supporting channel and is aligned to assure complete disengagement between the ring portions before rotation can occur. Once clear of the ring portion, the shaft is rotatable to position the movable ring portion in the second supporting channel and allow pages to be added or removed from the ring. FIG. 8 shows the rings in engagement, FIG. 9 shows the rings partially disengaged and FIG. 10 shows the rings fully disengaged.

Referring to FIG. 13 & 14, the shaft 61 has a guide passage 77 axially oriented along a bottom surface thereof. The passage has four slots 80. Four fins 79 extended into the passage 77 from a locating strip 74. The fins are located relative to the slots such that rotation will only occur when the fins are in alignment with the slots. When the fins are out of alignment with the slots, the shaft may only move axially and not be rotated. When in alignment with the slots, which corresponds to alignment of the ring portion 65 with the second supporting channel 74, the shaft is rotatable to allow removal of pages from the ring 65.

While preferred embodiments of the invention have been shown and described, it will be understood by those skilled in the art that various changes and modifications could be made without varying from the scope of the invention.

For example, while two bearing elements are shown, it will be understood that a single bearing element on one end would suffice to separate the binder rings. Also, the bearing element could contain projections which operate in grooves disposed in a lower surface to provide extra torque during opening and closure. Thus, any groove configuration which effectively direct the members to separate are within the scope of the invention.

I claim:

1. A ring binder separator having ring means mounted thereon, the separator comprising a first member and a second member, disposed in a facing relationship, each member having an arcuate channel, the channels being alienable to form a bearing passage, each channel having at least one directing groove; a hinge axis, about which the members are translatable, a hinge disposed along the hinge axis, a semi-cylindrical bearing element disposed within the bearing passage, the bearing element having at least one engaging means disposable within each of the directing grooves, the engaging means being slidable therein, the bearing element movable axially to direct the members to translate about the hinge and separate the members.

2. The ring binder separator of claim 1 wherein the ring means comprise at least one pair of ring halves, each half disposed on one of the members in a facing relationship.

3. The ring binder separator of claim 1 further comprising a backing strip having an integral hinge disposed parallel to the hinge of the first and second members.

4. The ring binder separator of claim 3 further comprising a front cover and a back cover, each extending from the backing strip.

5. The ring binder separator of claim 1 further comprising a front cover and a back cover, each extending from a pair of slots in the first and second members.

6. The ring binder separator of claim 1 wherein the members and bearing element are composed of a material from the group consisting essentially of plastic, steel or combinations thereof

7. The ring binder separator of claim 1 wherein the directing grooves further include inwardly directed ridges disposed adjacent the opposite ends thereof for receiving the engaging means therein.

8. The ring binder separator of claim 1 wherein the members are produced in upper and lower portions, means for attaching the upper portions to the lower portions.

9. The ring binder separator of claim 7 wherein the attaching means comprise pins extending from the upper portions and receptacles disposed in the lower portions for receiving the pins therein.

10. The ring binder separator of claim 9 wherein a pair of removable covers are disposed between the upper an lower portions.

11. The ring binder separator of claim 1 wherein the members and bearing element are composed of plastic and produced by extrusions or injection molding.

* * * * *